US007011549B1

(12) United States Patent
Lai

(10) Patent No.: US 7,011,549 B1
(45) Date of Patent: Mar. 14, 2006

(54) DAMAGE-FREE CARD CONNECTOR

(75) Inventor: Yaw-Huey Lai, Taipei (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 11/003,443

(22) Filed: Dec. 6, 2004

(30) Foreign Application Priority Data

Oct. 12, 2004 (TW) ..... 93130928 A

(51) Int. Cl.
*H01R 12/00* (2006.01)

(52) U.S. Cl. ..... 439/630

(58) Field of Classification Search ..... 439/630
See application file for complete search history.

(56) References Cited

U.S. PATENT DOCUMENTS 5,591,929 A * 1/1997 Wellman ..... 84/422.1
6,206,710 B1 * 3/2001 Chen ..... 439/159
6,607,405 B1 * 8/2003 Nishimura ..... 439/630
6,641,413 B1 * 11/2003 Kuroda ..... 439/159
6,814,622 B1 * 11/2004 Lai et al. ..... 439/631
6,908,321 B1 * 6/2005 Lai ..... 439/140
6,932,654 B1 * 8/2005 Washino ..... 439/630
6,957,983 B1 * 10/2005 Lai ..... 439/630

* cited by examiner

*Primary Examiner*—Tulsidas C. Patel
*Assistant Examiner*—Harshad C. Patel
(74) *Attorney, Agent, or Firm*—Bacon & Thomas, PLLC

(57) ABSTRACT

A damage-free card connector includes at least one slidable frame for accommodating at least one electronic card. The slidable frame has a pressing portion and a jacking portion respectively for pressing and jacking up terminals of the card connector. While a card is inserted, the terminals will be jacked up only if necessary and keep pressed to avoid unnecessary contact and impact resulted in deformation incurring failure of data access and malfunction of the card connector or the inserted card and to prolong the life of the card connector.

8 Claims, 13 Drawing Sheets

DAMAGE-FREE CARD CONNECTOR

BACKGROUND OF THE INVENTION

1. Field of the Invention

The present invention relates generally to electronic apparatuses, and more particularly to a damage-free card connector.

2. Description of the Related Art

Referring to FIG. 12, a conventional all-in-one card connector 70 compatible with various kinds of memory cards is comprised of a shell 71, inside which several partially overlapped card receiving sections are formed for receiving different cards and a plurality of terminals 73 are mounted for electrical connection with corresponding terminals of each card for transitional connection between an electronic device and an electronic card. Another conventional card connector 80, as shown in FIG. 13, employs an injecting/ejecting means 83 mounted in a shell 81 for manually ejecting an electronic card by the user.

However, since all of the terminals in each of the aforesaid conventional card connectors extend into the card receiving sections, while several cards are inserted into the card connector, the surface of each of the most of the cards passes by other sets of the terminals to cause friction and squeeze, and two guide sidewalls formed bilaterally at the corresponding terminal of some kind of the card, such as MS (Memory Stick) card, may cause deformation of the terminals to further incur abnormal access of data. Further, the deformed terminals are vulnerable to impact of other cards to incur greater deformation and even worse to incur failure of access due to the impact.

SUMMARY OF THE INVENTION

The primary objective of the present invention is to provide a damage-free card connector, which terminals can be protected from malfunction caused by deformation resulted from impact of an inserted electronic card.

The secondary objective of the present invention is to provide a damage-free card connector, which secures its terminals in electrical connection with corresponding terminals of an inserted electronic card.

The foregoing objectives of the present invention are attained by the damage-free card connector, which is comprised of a shell and an injecting/ejecting means. The shell includes an opening formed at its front end for inserting the card, a plurality of terminals mounted to the shell and extending into the shell for electrical connection with the corresponding terminals of the card, and at least one slidable frame inside. The slidable frame is driven by an external force to slidably reciprocate, having a predetermined shape for either pushing by a corresponding card to the shape or passing by another card, a plurality of recesses formed at its bottom side, and a jacking portion and a pressing portion respectively formed behind the recesses. A set of the terminals extends through the recesses and into the slidable frame. The injecting/ejecting means is mounted in the shell for working on the slidable frame and keeping the slidable frame in an injecting position or an ejecting position.

DETAILED DESCRIPTION OF PREFERRED EMBODIMENTS

Figure 1:
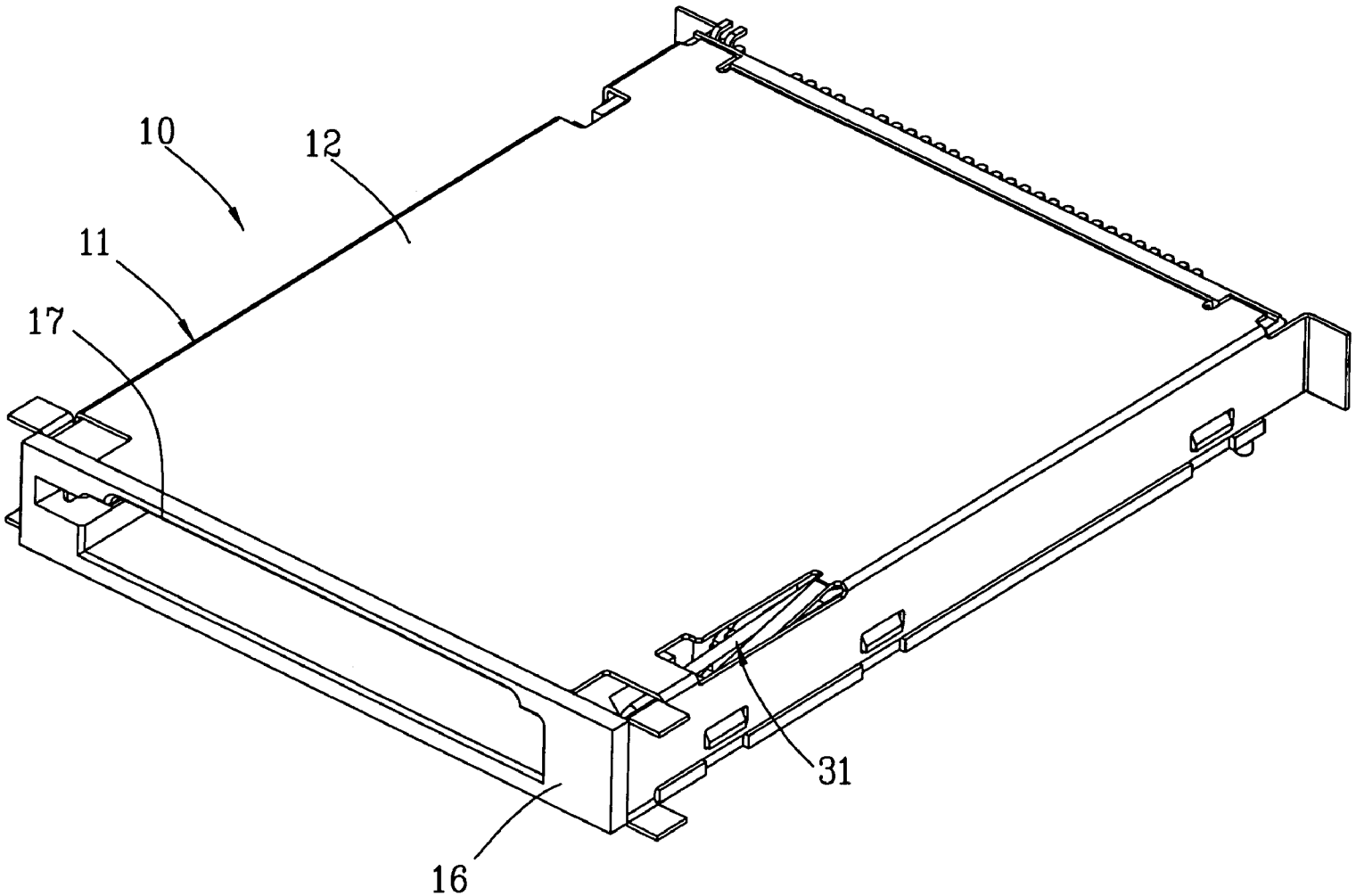
FIG. 1 is a perspective view of a first preferred embodiment of the present invention.
Figure 2:
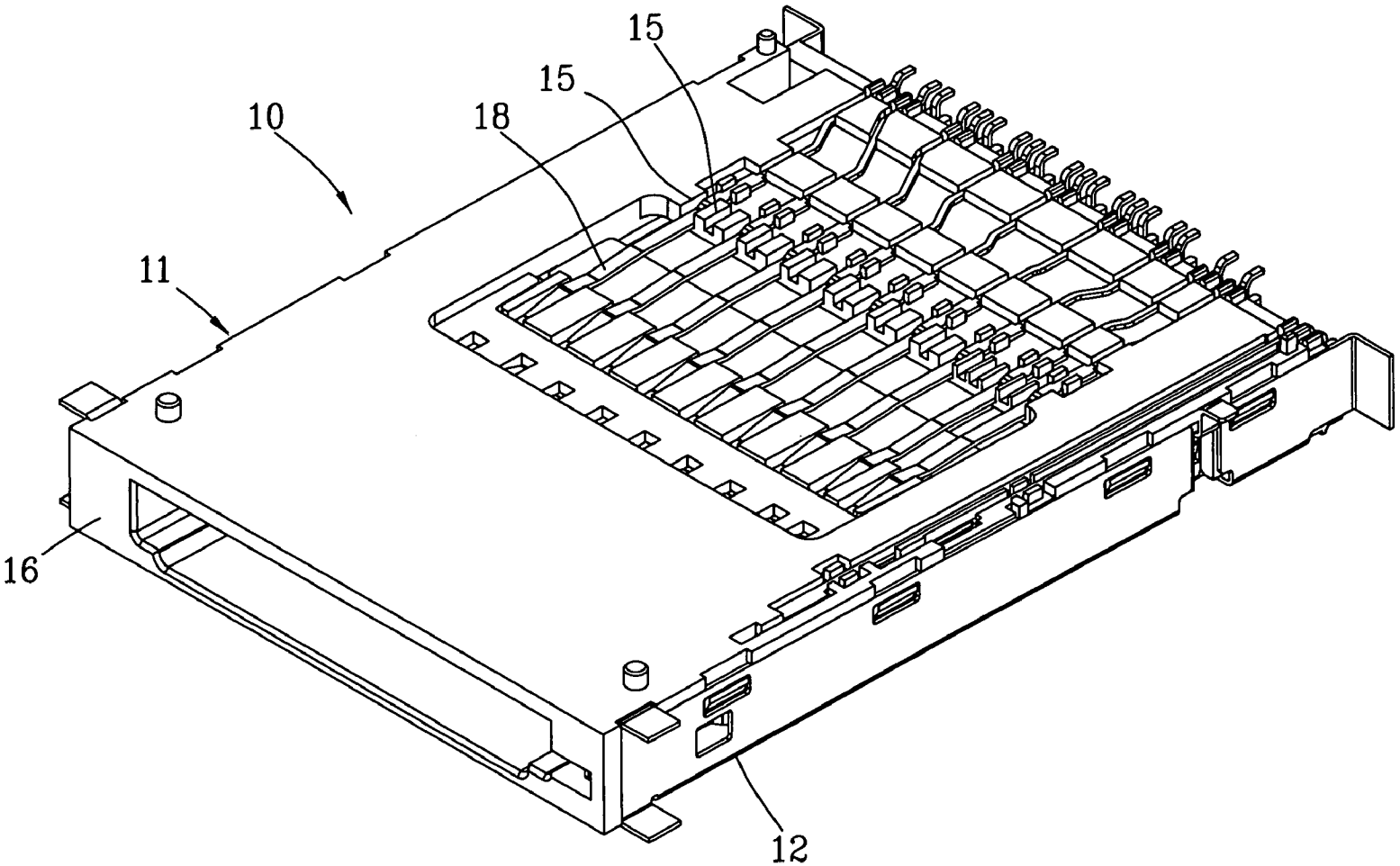
FIG. 2 is another perspective view taken from the bottom side according to the first preferred embodiment of the present invention.
Figure 3:
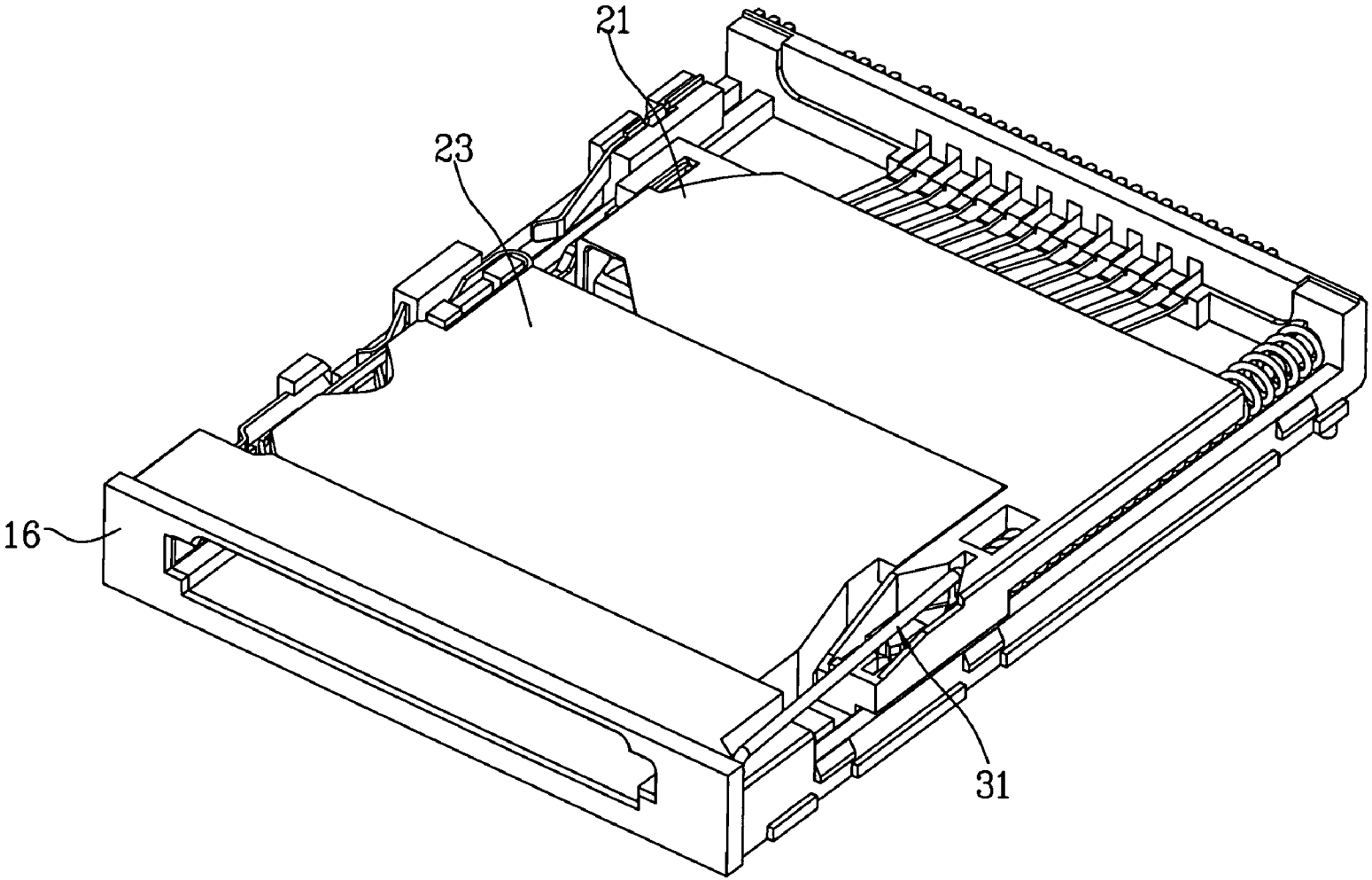
FIG. 3 is a perspective view of the first preferred embodiment of the present invention, which cover plate is removed.
Figure 4:
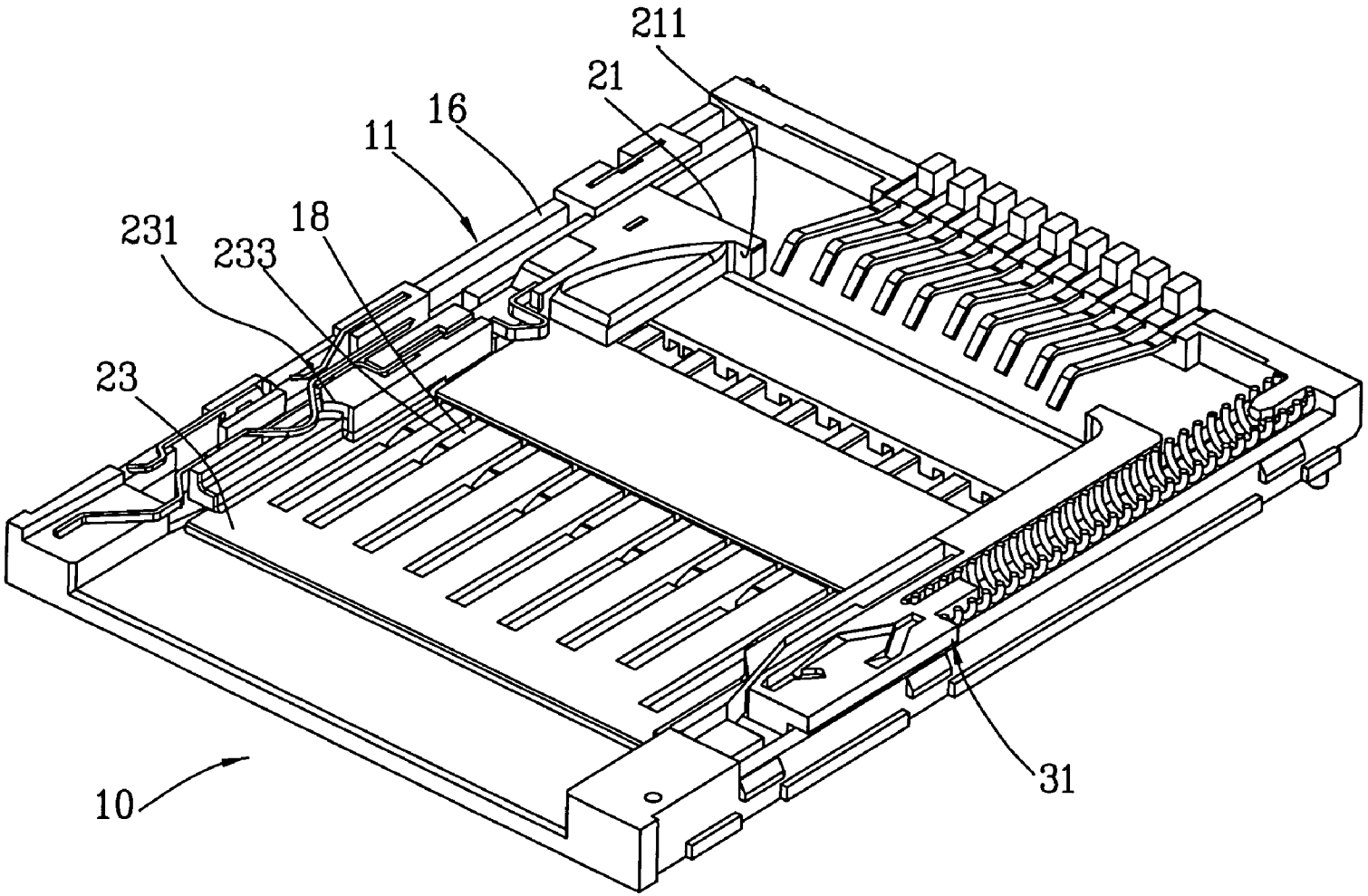
FIG. 4 is another perspective view of the internal structure according to the first preferred embodiment of the present invention.

Referring to FIGS. 1–4, a damage-free card connector 10 constructed according to a first preferred embodiment of the present invention is comprised of a shell 11 and an injecting/ejecting means 31, for inserting several kinds of electronic cards therein and rendering transitional connection between an electronic device (not shown) and a card 97.

The shell 11 includes a cover plate 12 and a base 16. The base 16 is partially hollow, having an opening 17 formed at a front end thereof for inserting the card 97, a plurality of recesses 15 formed at a bottom side thereof, and a plurality of terminals 18 partially disposed thereon and partially jammed in the recesses 15 and extending inwards for electrical connection with the corresponding terminals 971 of the inserted card 97.

Two slidable frames as a first slidable frame 21 and a second slidable frame 23 are slidably mounted one after the other inside the base 16 for reciprocating movement by a force, respectively having different shapes for accommodating different kinds of the cards 97; in other words, while the card 97 is inserted, each of the two slidable frames 21 and 23 can either contact against the card 97 and push it forwards while the card 97 corresponds thereto in shape or let the card 97 pass therethrough while the card 97 does not correspond thereto. The slidable frames 21 and 23 each have an action spot 211(231) and each correspond to one set of the terminals 18 located thereunder. While the corresponding card 97 is inserted, the card 97 contacts against either of the action spots 211 and 231 to push forward either of the slidable frames 21 and 23. The first slidable frame 21 is compatible with a card, which width or thickness is smaller and which contact pins are located much inwards, such as MS card. The second slidable frame 23 is compatible with a card, which width or thickness is larger, such as MMC (Multi Media Card) or SD (Secure Digital) card. The terminals 18 corresponding to the first slidable frame 21 extend into the first slidable frame 21. The second slidable frame 23 has a plurality of slots 233 formed at a bottom side thereof, and a pressing portion 235 and a jacking portion 237 formed respectively behind the slots 233. The terminals 18 pass through between the pressing portion 235 and the jacking portion 237. While the second slidable frame 23 approaches the opening 17, the terminals 18 are pressed by the pressing portion 235 to be located under the second slidable frame 23. While the second slidable frame 23 approaches a rear side of the base 16, the terminals 18 are jacked up by the jacking portion 237 to extend into the second slidable frame 23 through the slots 233.

The injecting/ejecting means 31 is mounted between the base 16 and the first slidable frame 21 for securing the first slidable frame 21 at an injecting position (accessible spot) or an ejecting position (inaccessible spot). Since the injecting/ejecting means 31 is structurally identical to the prior art, no further recitation is necessary.

Figure 5:
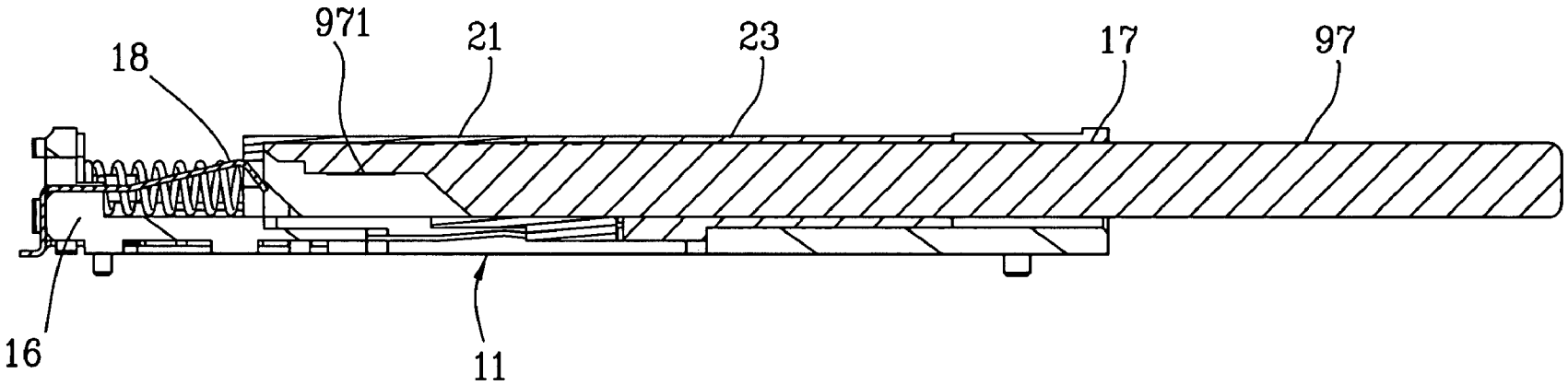
FIG. 5 is a sectional view of the first preferred embodiment of the present invention, into which an MS card is inserted.
Figure 6:
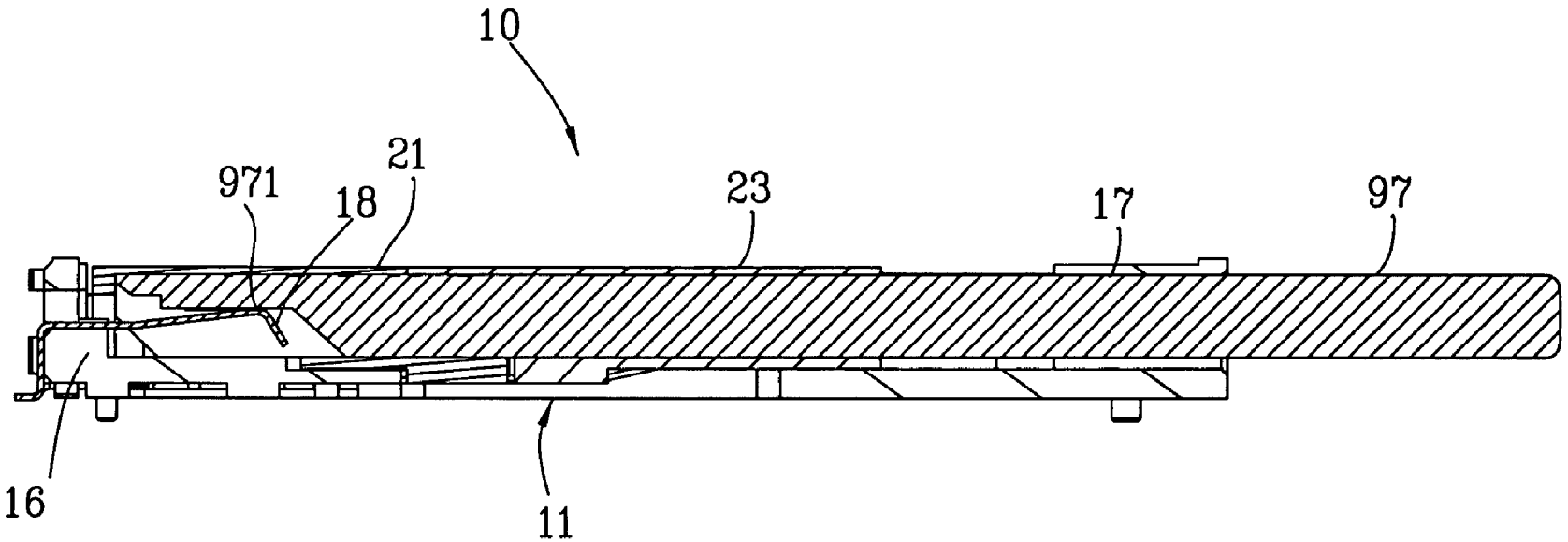
FIG. 6 is similar to FIG. 5, showing that the MS card is pushed to an injecting position.

FIGS. 5–6 illustrate the present invention in operation according to the first preferred embodiment. While a card 97 accommodates the first slidable frame 21, like MS card, is inserted into the card connector 10, the card 97 passes through the second slidable frame 23 to contact against the action spot 211 of the first slidable frame 21 and then to push the first slidable frame 21 backwards. Until the first slidable frame 21 is pushed to the injecting position, the terminals 18 located under the first slidable frame 21 contact the corresponding terminals 971 of the card 97; meanwhile, the second slidable frame 23 remains still to enable the pressing portion 235 to press the terminals 18 under the second slidable frame 23 and to prevent the terminals 18 from extending into the second slidable portion 23, thereby avoiding scratching the card 97 while the card 97 passes through. Pushing the card 97 once again will enable the injecting/ejecting means 31 to eject the card 97.

Figure 7:
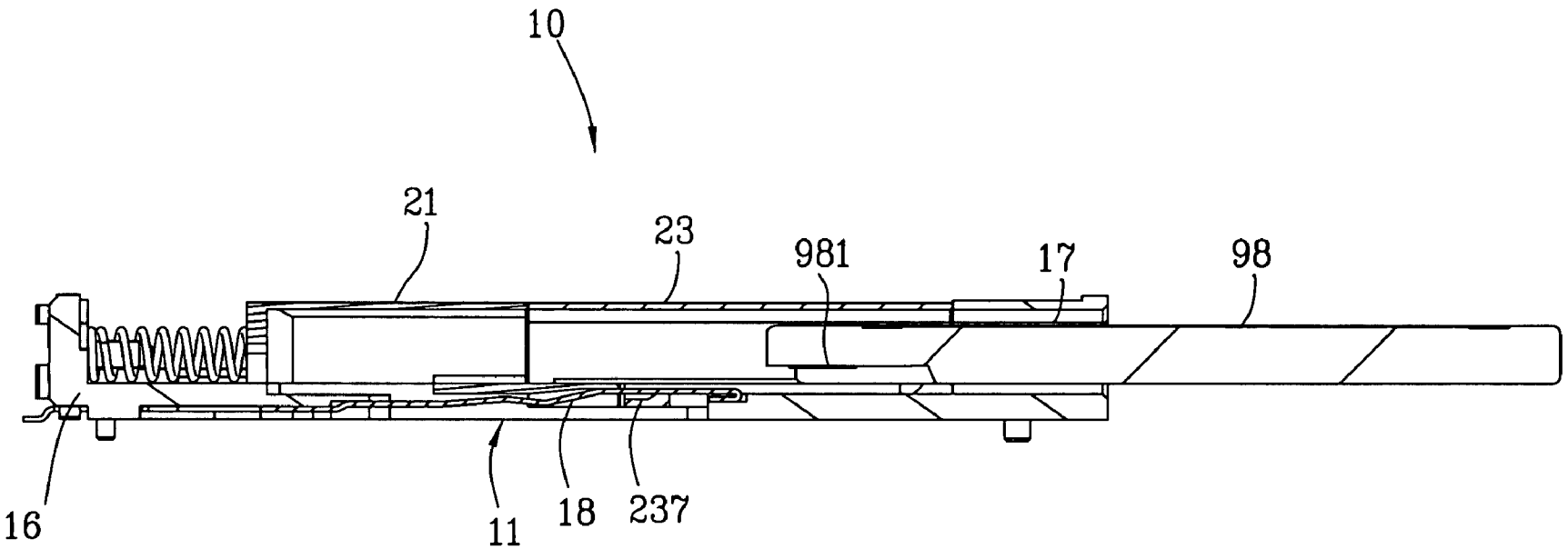
FIG. 7 is a sectional view of the first preferred embodiment of the present invention, into which an SD card is inserted.
Figure 8:
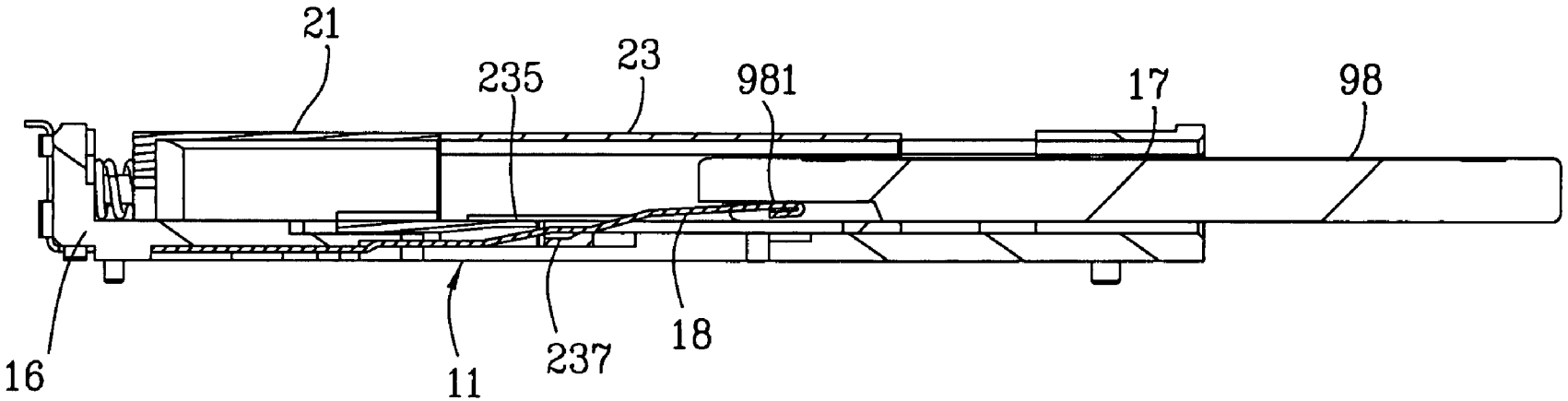
FIG. 8 is similar to FIG. 7, showing that the SD card is pushed to the injecting position.

Referring to FIGS. 7–8, while a card 98 accommodates the second slidable member 23, like SD or MMC card, the card 98 contacts against the action spot 231 of the second slidable frame 23 and pushes the slidable frame 23 together with the first slidable frame 21 backwards; meanwhile, the terminals 18 are free of the pressure caused by the pressing portion 235 and then jacked up by the jacking portion 237 to contact the corresponding terminals 981 of the card 98. Since the first slidable frame 21 is slidably moved backwards together with the second slidable frame 23, the injecting/ejecting means 31 keeps the first slidable frame 21 still at the injecting position. Pushing the card 98 once again will enable the injecting/ejecting means 31 to push the first slidable frame 21 together with the second slidable frame 23 to eject the card 98.

Figure 9:
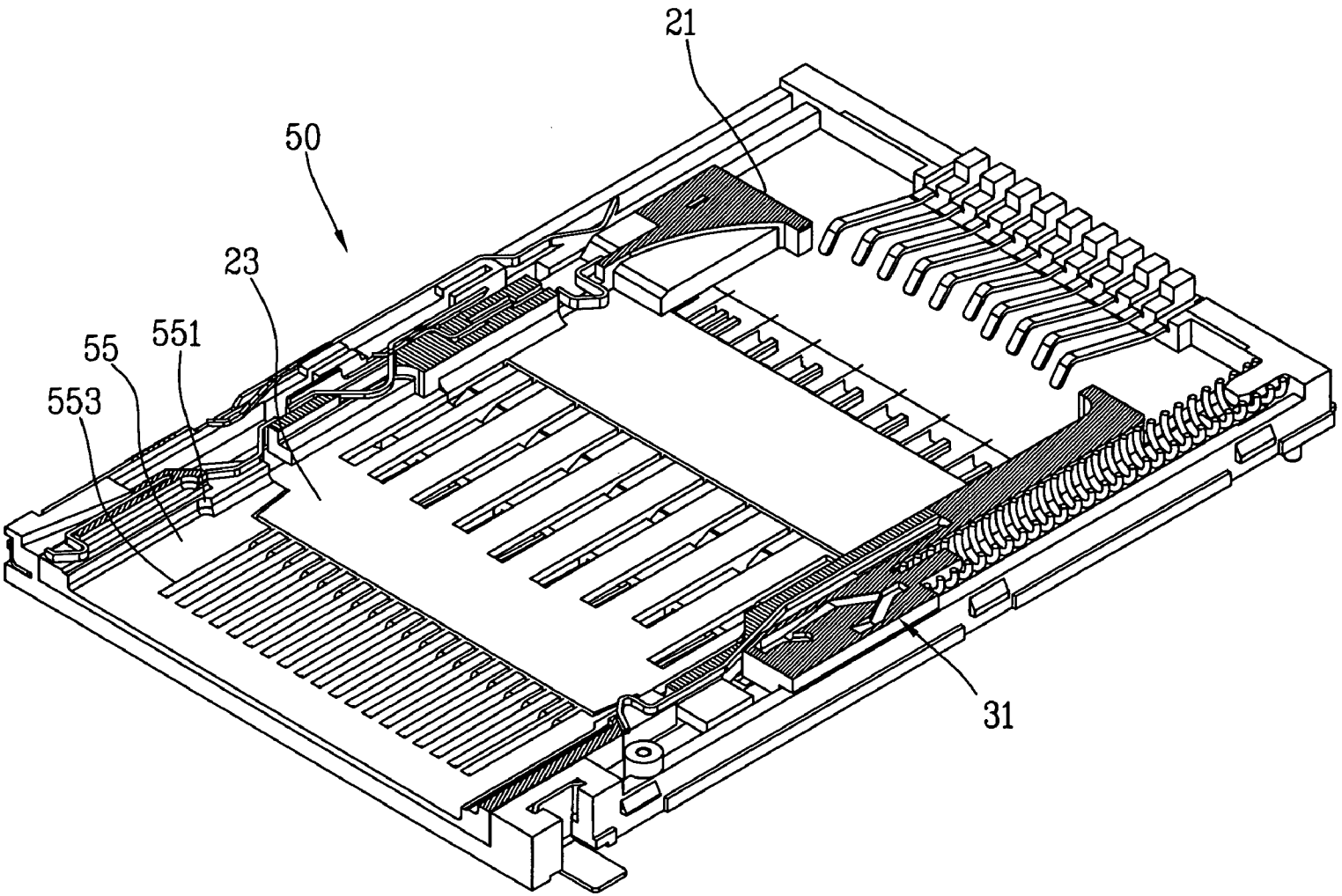
FIG. 9 is a perspective view of the internal structure according to a second preferred embodiment of the present invention.
Figure 10:
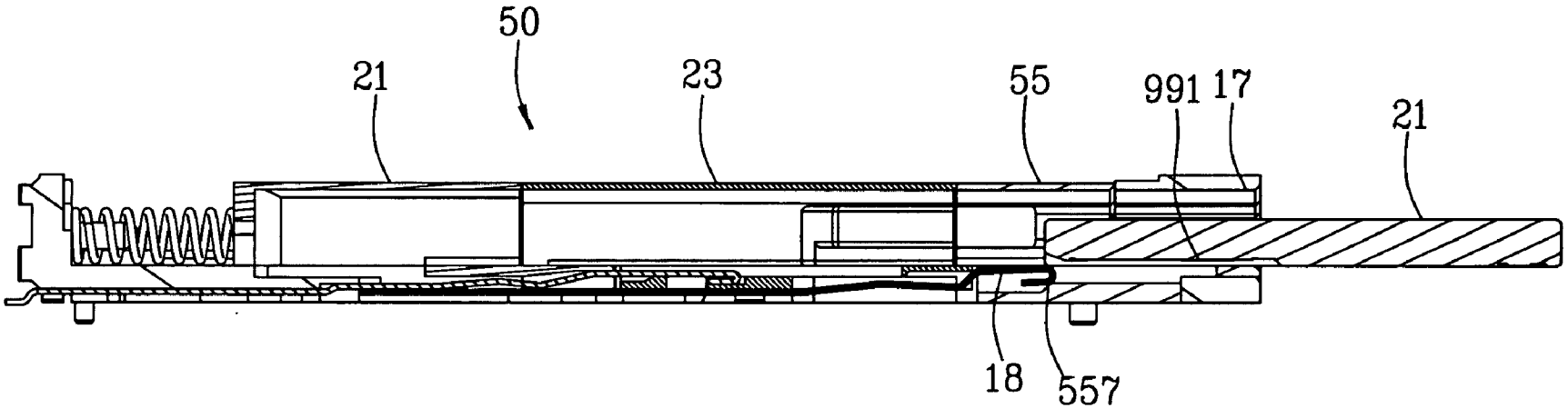
FIG. 10 is a sectional view of the second preferred embodiment of the present invention, into which an XD card is inserted.
Figure 11:
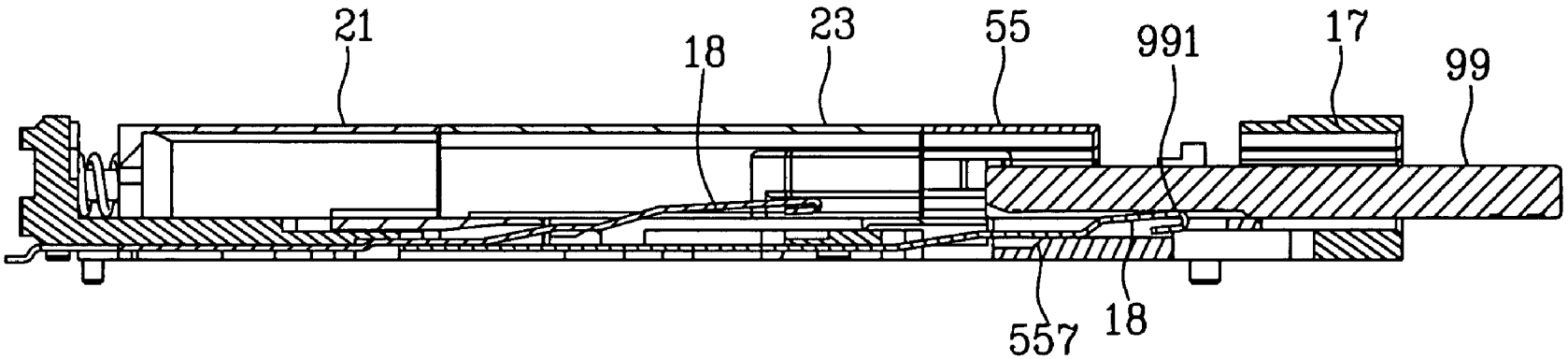
FIG. 11 is similar to FIG. 10, showing that the XD card is pushed to the injecting position.
Figure 12:
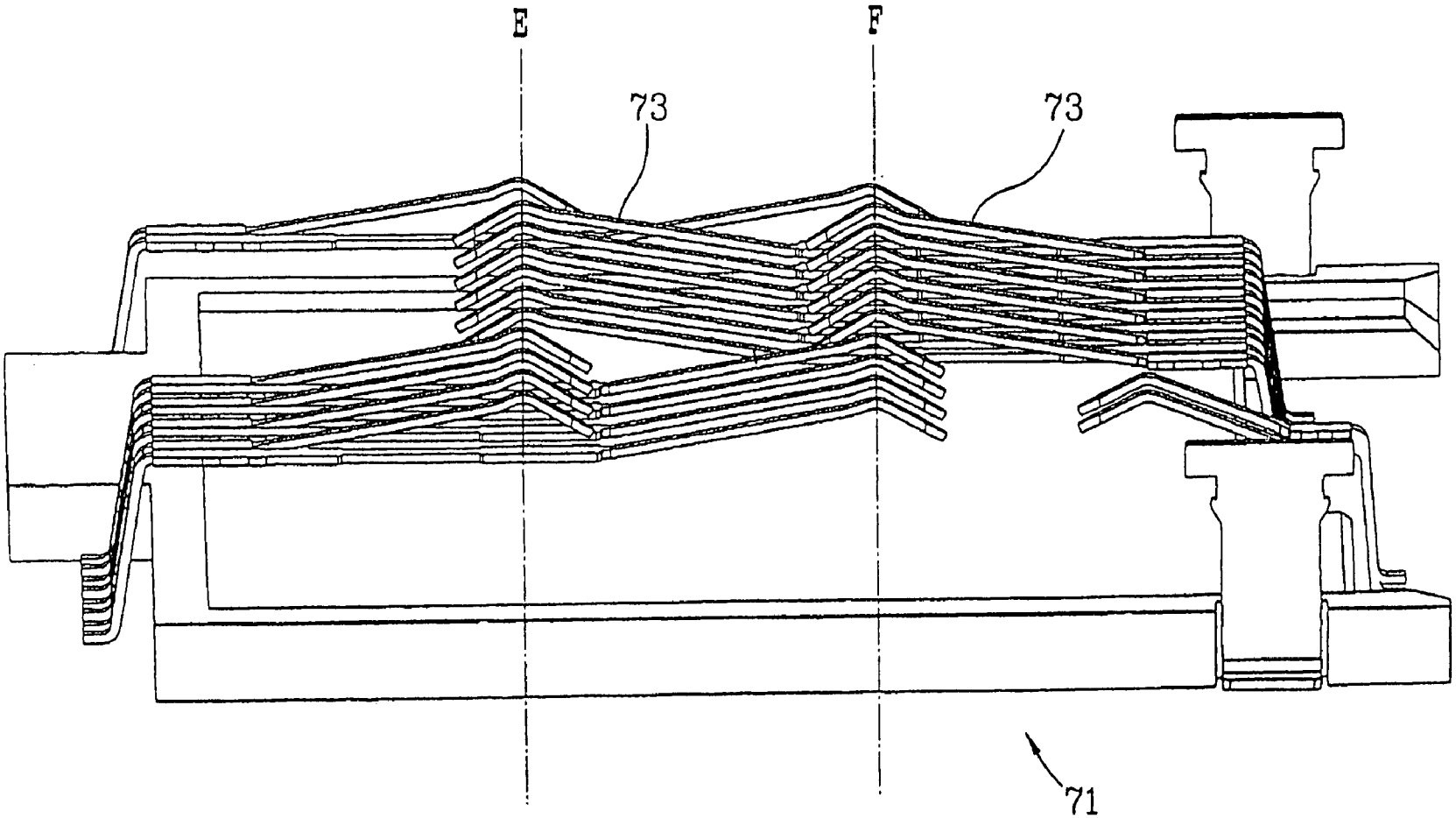
FIG. 12 PRIOR ART
FIG. 12 is a schematic view of a conventional all-in-one card connector.
Figure 13:
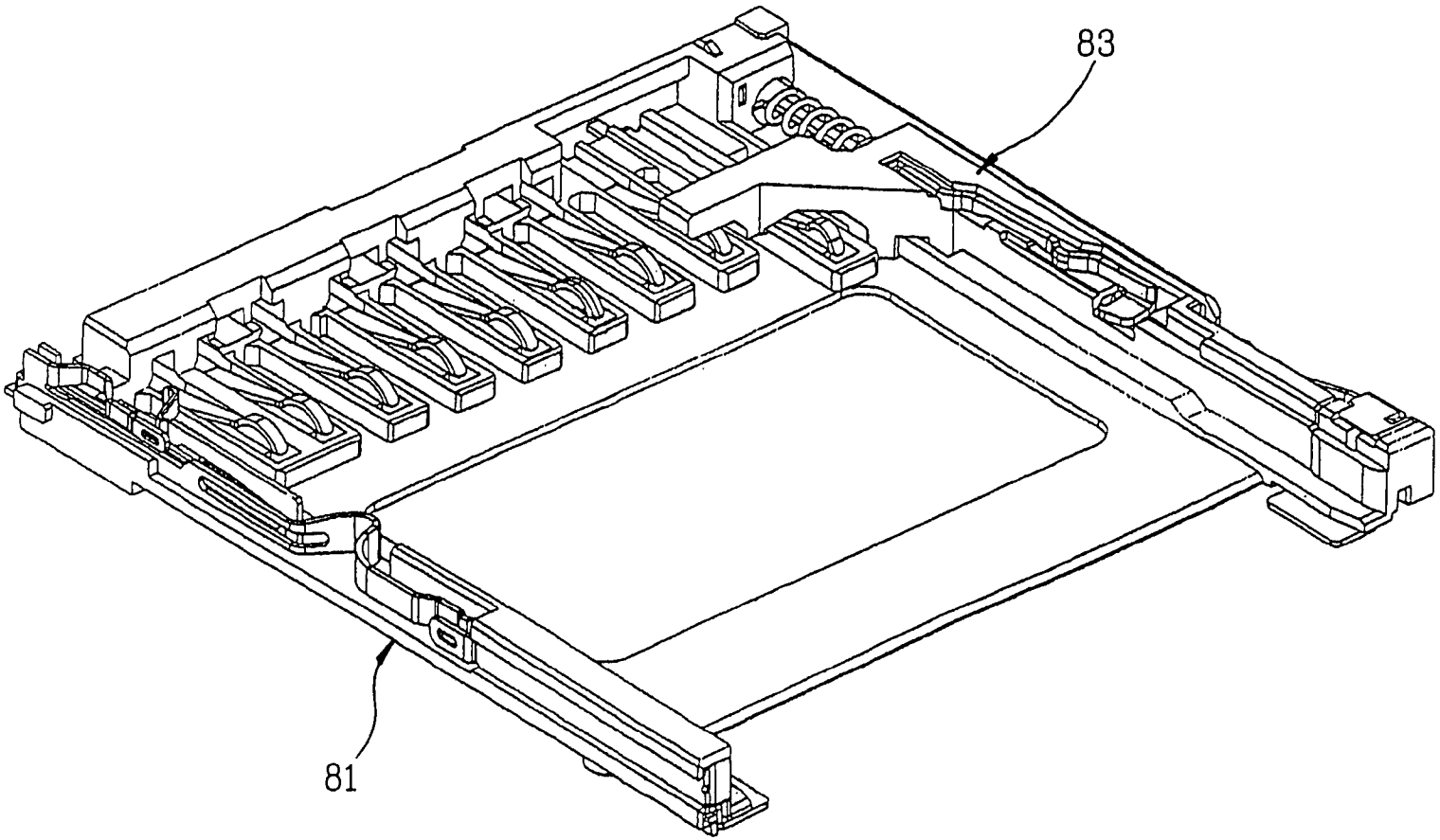
FIG. 13 PRIOR ART
FIG. 13 is a schematic view of another conventional all-in-one card connector.

Referring to FIGS. 9–11, the damage-free card connector 50 constructed according to a second preferred embodiment of the present invention is similar to the aforementioned embodiment, but having difference as recited below.

The card connector 50 further includes a third slidable frame 55, which is located between the second slidable frame 23 and the opening 17. A set of the terminals 18 is located under the third slidable frame 55, corresponding to the third slidable frame 55. The card connector 50 is compatible with a card, which width is larger than the card 98, having an action spot 551, a plurality of slots 553 formed at a bottom side thereof, and a jacking portion 557 located behind the slots 553.

Referring to FIGS. 10–11, the card connector 50 is similar to the card connector 10 in operation, but having difference as follows. While a card 99 is compatible with the slidable member 55, like XD (eXtreme Digital) card, is inserted, the card 99 contacts against the action spot 551 of the third slidable frame 55 and pushes the third slidable frame 55 together with the slidable frames 21 and 23 backwards, the terminals 18 under the third slidable frame 55 are jacked up by the jacking portion 557 to contact the corresponding terminals 991 of the card 99. Since the first slidable frame 21 is slidably moved backwards together with the slidable frames 23 and 55, the injecting/ejecting means 31 keeps the first slidable frame 21 still at the injecting position. Further, the card 99 is shorter than the cards 98 and 97, thereby failing to contact the jacked terminals 18 under the second slidable frame 23. Pushing the card 99 once again will enable the injecting/ejecting means 31 to push the first slidable frame 21 together with the slidable frames 23 and 55 to eject the card 99.

In addition, the present invention can alternatively employ only one slidable frame to jack up or down one set of the terminals selectively. In other words, while the inserted card passes through the slidable frames, the terminals will be jacked up for contact only if necessary and keep pressed to avoid unnecessary contact, friction, or impact.

In conclusion, the present invention includes several advantages as follows.

1. Protect the terminals: While a card is inserted, the terminals will be jacked up for contact if necessary to avoid deformation resulted from unnecessary contact with or impact by the card. If the card, such as MS card, is smaller in width, the card will not contact the action spots of the first and second slidable frames, which width is incompatible with the card, passing through the incompatible slidable frames and further working on the action spot of the compatible third slidable frame. During the insertion of the card, the terminals under the incompatible slidable frames are kept pressed from jacking up and extending into the slidable frames, further being not touched and even impacted by the card. If the card, such as SD card, is wider, the card will pass through the first slidable frame to work on the second slidable frame but the third slidable frame without contacting the terminals under the first and third slidable frames. Thus, the present invention prevents the terminals from extending into any of the incompatible slidable frames to further avoid not only the terminals from squeeze and deformation incurred by the inserted card but also the card from scratch incurred by the terminals.

2. Prolong the life of the card connector: Since the terminals are pressed by the compatible slidable frames not to be squeezed by any of the incompatible card and to keep in contact with the compatible card, it not only reduces the wear and tear of the terminals by any of the incompatible cards but also prolong the life of the card connector.

3. Perfect contact: While the compatible slidable frames are moved, the terminals under it are jacked up or pressed. While the compatible card is inserted, the corresponding terminals are jacked up by the jacking portion to avoid any error action and to ensure perfect contact between the terminals of the card connector and the corresponding terminals of the card.

What is claimed is:

1. A damage-free card connector for inserting an electronic card, said card having corresponding terminals, said card connector comprising:

a shell having an opening formed at its front end for inserting said card, a plurality of terminals disposed thereto and extending therein for electrical connection with said corresponding terminals of said card, and a slidable frame mounted inside for reciprocating movement by a force, said slidable frame having a predetermined shape for either pushing by a corresponding card to said shape or passing by another card, said slidable frame having a plurality of recesses formed at its bottom side, and a jacking portion and a pressing portion respectively formed behind said recesses, a set of said terminals extending through said recesses and into said slidable frame; and an injecting/ejecting means mounted in said shell and working on said slidable frame for keeping said slidable frame in an injecting position or an ejecting position.

2. The card connector as defined in claim 1, wherein said shell comprises a base and a cover plate.

3. The card connector as defined in claim 1, wherein said shell comprises a plurality of recesses formed thereon; parts of said terminals are partially jammed in said recesses.

4. The card connector as defined in claim 1, wherein said shell comprises two slidable frames arranged one after the other respectively for accommodating relatively narrower and wider cards.

5. The card connector as defined in claim 4 further comprising another slidable frame located between said opening of said shell and said two slidable frames for accommodating relatively wider card.

6. The card connector as defined in claim 1, wherein said shell comprises two slidable frames arranged one after the other respectively for accommodating relatively thinner and thicker cards.

7. The card connector as defined in claim 6 further comprising another slidable frame located between said opening of said shell and said two slidable frames for accommodating relatively thicker card

8. The card connector as defined in claim 1, wherein said slidable frame comprises an action spot, said slidable frame being pushed by an inserted card working on said action spot.

* * * * *